United States Patent [19]

Santino

[11] Patent Number: 4,841,885

[45] Date of Patent: Jun. 27, 1989

[54] ADJUSTABLE LENGTH NEEDLE IMPLEMENT

[75] Inventor: Michael Santino, San Marcos, Calif.

[73] Assignee: The Special Touch, San Marcos, Calif.

[21] Appl. No.: 262,521

[22] Filed: Oct. 25, 1988

[51] Int. Cl.[4] ..... D05C 15/06

[52] U.S. Cl. ..... 112/80.03; 112/80.05

[58] Field of Search ..... 112/80.03, 80.05

[56] References Cited

U.S. PATENT DOCUMENTS

| | | | |
|---|---|---|---|
| 1,464,897 | 8/1923 | Atkinson | 112/80 |
| 1,878,889 | 9/1932 | Roberts | 112/80 |
| 2,097,380 | 10/1937 | Morgan | 112/80 |
| 2,610,598 | 9/1952 | Midas | 112/80 |
| 3,050,896 | 8/1962 | Parker | 223/104 X |
| 3,938,452 | 2/1976 | Windle | 223/104 X |
| 4,135,458 | 1/1979 | Samoilou | 112/80.05 |
| 4,306,510 | 12/1981 | O'Brien | 112/80 |
| 4,479,445 | 10/1984 | Walker | 112/80 |

*Primary Examiner*—Ronald Feldbaum

*Attorney, Agent, or Firm*—Baker, Maxham, Jester & Meador

[57] ABSTRACT

A thread carrying needle assembly usable for a variety of craft purposes, the needle assembly having means to adjust the length of the exposed pointed end of the needle. A safety feature is that the needle may be fully retracted within the housing. The needle assembly is adapted to function with a conventional needle element which is easily replaceable.

12 Claims, 2 Drawing Sheets

ADJUSTABLE LENGTH NEEDLE IMPLEMENT

FIELD OF THE INVENTION

A craft implement and more particularly a device having a handle and a needle where the needle is adjustable in length with respect to the handle.

BACKGROUND OF THE INVENTION

There are many art or craft implements employing needles for such purposes as embroidering and making hooked rugs, among others, which may require a loop of yarn or other material on one side of a fabric backing, for example. Such tools typically have a needle with an eye closely adjacent the pointed end. Such instruments normally having a handle which is comfortable for the user's hand have been made in different lengths but each needle and handle combination has typically had a fixed length relationship.

It has been found to be desirable to have such an implement with a needle having an adjustable length with respect to the handle for different length of loops or for other purposes. Examples of such a device are shown in U.S. Pat. Nos. 4,306,510 and 4,479,445. These devices have different structures but both of them have the purpose of providing an adjustable length needle in a craft implement. The first patent has a plastic handle with a cylindrical axial opening adapted to receive a unitary needle element having a threaded end and a pointed end. A threaded nut rotatable with respect to the handle is employed to adjust the length of the needle so that it projects outwardly from the handle by differing amounts. A pin and slot arrangement prevent rotation of the needle in the handle. U.S. Pat. No. 4,479,445 also provides a plastic handle with a needle element comprising a unitary needle and holder which are rotatably secured within the handle. This device rotates the entire needle element within the handle for accomplishing longitudinal adjustments. A projection inside the handle slidingly engages the threads on the holder to cause the relative longitudinal motion. This second patent is particularly adapted to incorporate a cannulation needle used in hypodermic syringes and is a simple adapter for use of such readily available needles.

A disadvantage of some of the prior art devices is that the needle and the adjusting threads are formed on a unitary member. Thus if the needle is changed, the threaded portion must also be changed. Alternatively the whole unit is disposable. Additionally, some of the prior art devices do not have means for retracting the needle point fully within the handle, thereby creating a safety hazard. Furthermore, U.S. Pat. No. 4,306,510 requires an additional element attached to the needle and an open slot in the handle portion to prevent rotation. This requires additional elements and the possibility of fouling the upper portion of the needle and the threads because they are exposed to the external environment and accompanying contamination through the slot in the side of the handle.

SUMMARY OF THE INVENTION

This invention relates generally to an adjustable thread carrying craft implement and more particularly to a craft handle having a needle mounted therein which may project from one end of the handle to readily adjustable lengths and may be fully retracted within the handle for safety purposes.

The housing which comprises the handle has one end with a small opening through which the needle projects and a cylindrical barrel in which a threaded cylindrical sleeve resides. The sleeve is adapted to firmly but removably retain a conventional combination needle and mounting element. The sleeve has external threads which engage the internal threads of a nut which is rotatably mounted in the housing. A projection and groove arrangement or mating flat surfaces on the threaded sleeve and the interior surface of the housing provide alternative means to prevent relative rotation of the sleeve in the housing.

As an alternative embodiment, the needle may be removably mounted directly to a modified threaded sleeve element instead of being mounted to a mounting element which combination is then mounted to the threaded sleeve. Both the needle and mounting element assembly and the removable needle are readily available from conventional sources and are adapted to be employed in the implement of the invention.

BRIEF DESCRIPTION OF THE DRAWING

The objects, advantages and features of this invention will be more readily perceived from the following detailed description, when read in conjunction with the accompanying drawing, in which.

DETAILED DESCRIPTION OF THE PREFERRED EMBODIMENTS

Figure 1:
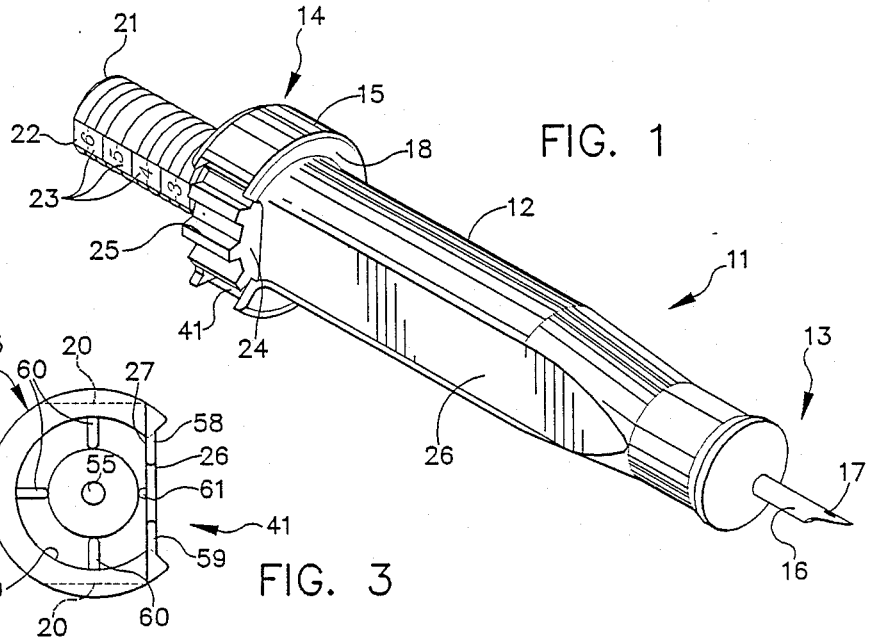
FIG. 1 is a perspective view of the thread carrying needle assembly of the invention.

With reference now to the drawing, and more particularly to FIGS. 1–4 thereof, needle assembly 11 is comprised of housing 12 having forward or needle end 13 and opposite rear end 14. Enlarged raceway 15 is provided at the rear end of housing 12 and is comprised of semicircular rims 18 and 19 and bridging elements 20. Needle 16 is shown projecting a short distance outwardly from needle end 13 of the housing. The needle is formed with eye 17 in the point, adapted to receive thread therethrough, after passing through the axis of the hollow needle. Threaded sleeve 21 is shown projecting rearwardly from housing 12. On a flat longitudinal surface 22 are shown indicia 23 indicating a relative distance of needle projection outwardly from the housing. Threaded nut 24 is shown with a grooved external surface 25. The nut may well have a knurled or other roughened surface to facilitate rotation thereof. Flat side 26 of housing 12 is provided for lettering or other appropriate indicia and for purposes of orientation by means of the user when the implement is grasped. Additionally, that portion of housing 12 which includes flat external surface 26 also includes flat internal surface 27, the purpose of which will be explained below.

Figure 5:
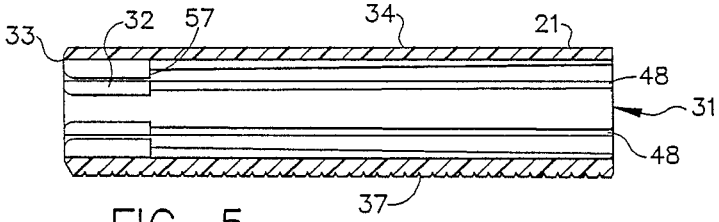
FIG. 5 is a reduced scale sectional view of the threaded sleeve mounted within the housing showing the tapered ribs somewhat exaggerated.
Figure 6:
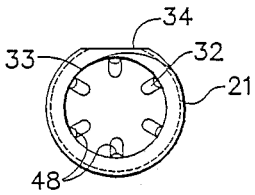
FIG. 6 is a right end view of the sleeve of FIG. 5.

Referring now to FIG. 5, threaded sleeve 21 is shown with internal axial opening 31 adapted to receive a needle and mounting element assembly. Stop members 32 are provided adjacent end 33 of the threaded sleeve against which the end of the needle element is positively retained. Flat side 34 (FIG. 6) is adapted to mate with flat surface 27 on the inside of housing 12 to prevent rotation of the threaded sleeve and needle element within the housing.

Figure 3:
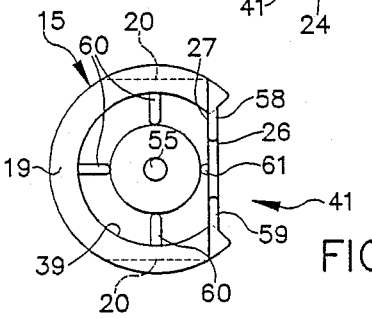
FIG. 3 is an end view from the rear end of the assembly of FIG. 2.
Figure 2:
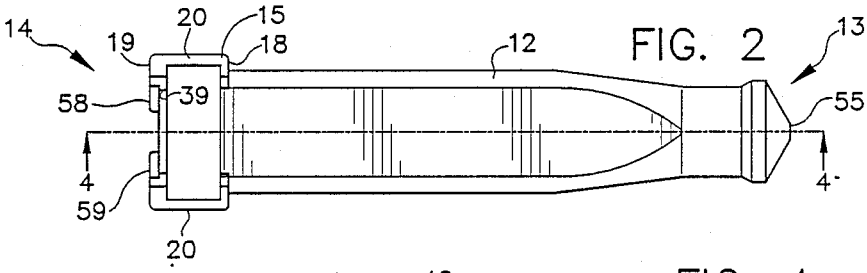
FIG. 2 is a side, partially cut away sectional view of the invention of FIG. 1.
Figure 4:
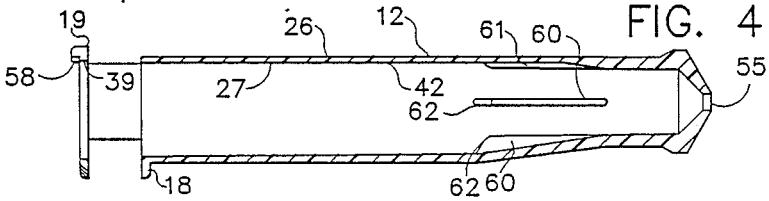
FIG. 4 is a sectional view taken along cutting plane 4—4 of FIG. 3.
Figure 8:
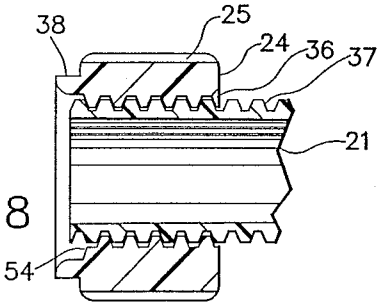
FIG. 8 is an enlarged sectional view of the threaded nut and sleeve arrangement of the invention.

The threaded nut arrangement is shown in greater detail in FIG. 8. Nut 24 is shown with internal threads 36 mating with external threads 37 on threaded sleeve 21. The nut rotates freely in raceway 15 and one portion of the grooved surface 25 is accessible through opening 41 in the raceway (FIGS. 1 and 3). There may be a similar opening in the raceway on the opposite side thereof, at least that portion between bridging elements 20 and rims 18 and 19. Nut 24 is provided with reduced diameter annular shoulder 38 which projects rearwardly through the center opening 39 of rim 19. This shoulder helps stabilize the nut in the raceway and ensures that it is captured therein when it is snapped in from side opening 41. When the sleeve is inserted into hollow generally cylindrical axial opening 42 in housing 12, threads 36 and 37 are mutually engaged and the sleeve is advanced toward the needle end of the housing by rotation of nut 24. The length of needle 16 projecting forwardly from housing 12 can easily be adjusted with one hand, where the user's thumb rotates nut 24, while the hand holds the housing.

Figure 7:
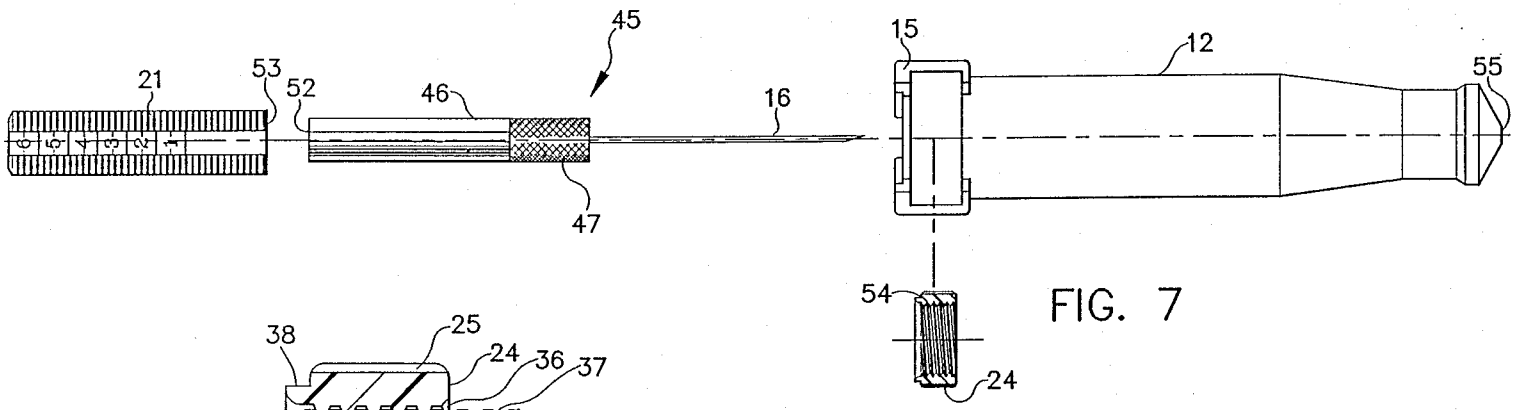
FIG. 7 is an exploded side view of the invention.

From FIG. 7, the elements of the device and their relationships can more easily be seen. Nut 24 is shown in cross section below raceway 15 and housing 12. Threaded sleeve 21 is shown at the far left of FIG. 7. In the center portion of the figure is needle assembly 45 comprised of needle 16 and mounting element or handle 46. This needle assembly is a readily available component which may be found in a craft store. Knurled surface 47 is provided and needle assembly 45 is usable as is if desired for other purposes. Sleeve 21 is formed with a hollow cylindrical center portion adapted to receive handle 46 of the needle element. Ribs 48 inside sleeve 21 are formed with a slight taper closing toward stop members 32 to provide a pressure or slip fit with respect to handle 46. Interior shoulders 51 on enlarged ribs 32 as shown in FIG. 5 provide a positive seat for end 52 of needle assembly mounting element 46.

When sleeve 21 and needle assembly 45 are engaged, the combination of them is inserted through the threaded opening of nut 24 into housing 12 with flat side 34 on the sleeve aligned with interior flat surface 27 in housing 12. To ensure initial alignment of the sleeve as it enters the housing, tabs 58 and 59 extend chordally toward each other from the open side of rim 19. The inner sides of these tabs form an extension of flat surface 27 and the outer sides are preferably an extension of external flat surface 26. Thus before the threads of the nut and sleeve engage, the sleeve is properly aligned with flat surface 27. When the threads at end 53 of sleeve 21 engage the threads at end 54 of nut 24, the needle assembly is fully within housing 12 and no portion of the point of the needle projects outwardly therefrom through forward hole 55. As nut 24 is rotated in the proper direction, the that after a longitudinal movement of a portion of the length of sleeve 21,-needle 16 begins to project outwardly through opening 55 in needle end 13 of housing 12. Because the point of needle 16 may be slightly misaligned with opening 55 as the needle moves forward, centering ribs 60 and 61 are formed on the inside of housing 12 starting slightly rearwardly from opening 55 and extending for a portion of the distance toward the rear end of the housing. The forward portion of mounting element 46 rides up on ramps 62 of the centering ribs to positively center needle 16 in opening 55. When the desired position is attained so that the indicia shown in FIGS. 1 and 7 on sleeve 21 are in the desired position, rotation of nut 24 is stopped and the needle is then used for the craft purpose a intended.

Figure 9:
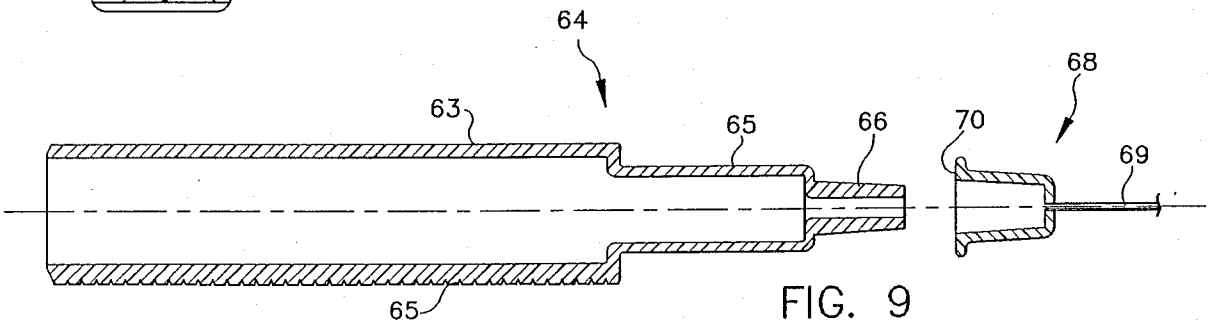
FIG. 9 is a side sectional view of an alternative embodiment of the threaded sleeve and needle.

An alternative embodiment for the needle and sleeve assembly is shown in FIG. 9. The main portion 63 of sleeve 64 is formed with smaller forward cylindrical portion 65 and needle fairing 66. Portion 63 is formed with threads 67 functioning identically with threaded sleeve 21. Fairing 66 is adapted to receive needle 68 (without handle 46) which needle is also readily available. The needle is then anchored in a conventional manner on fairing 66 and the unitary element is inserted into housing 12 and moved by means of nut 24 as previously discussed. Needle 68 has penetrating end 69 and standard Luer lock end 70, adapted to positively engage fairing 66.

It is contemplated that the housing, nut and sleeve elements of this invention will be made from a relatively rigid plastic material which is easily formed as desired. The elements could be made from any suitable material, so plastic is not a limitation. The needle is of course made of an appropriate material such as stainless steel. Handle member 46 is made of aluminum or a plastic or other suitable material.

In view of the above description, it is likely that modifications and improvements will occur to those skilled in the art which are within the scope of the appended claims.

What is claimed is:

1. An adjustable length thread carrying needle assembly comprising:

an elongated housing having a needle end, a rear end and an axis extending through said housing and both said ends, said housing having an internal generally cylindrical cavity extending from a point spaced rearwardly from said needle end and opening outwardly at said rear end;

an internally threaded nut mounted at said rear end for rotation with respect to said housing;

elongated needle retaining means having a threaded outer cylindrical surface, said threaded surface being engageable by said threads in said nut, said needle retaining means being adapted to removably retain a needle element comprising a needle which may be fully retracted within said housing; and means on the inside of said housing and mating means on said needle retaining means for preventing relative rotation of said housing and said needle retaining means;

whereby rotation of said nut causes longitudinal movement of said needle retaining means within said housing to selectively adjust the length of said needle projecting outwardly from the needle end of said housing.

2. The needle assembly recited in claim 1, wherein said rotation preventing means comprises mating flat surfaces on the inside of said housing and on the outer surface of said needle retaining means.

3. The needle assembly recited in claim 1, wherein said nut is formed with a grooved outer surface.

4. The needle assembly recited in claim 1, wherein said nut is formed with a knurled outer surface.

5. The needle assembly recited in claim 1, wherein at its most retracted position with respect to said housing, said needle is fully enclosed within said housing.

6. The needle assembly recited in claim 1, wherein said needle element comprises a needle and a mounting element means formed as a unitary assembly, said mounting element being adapted to be received within said needle retaining means.

7. The needle assembly recited in claim 6, wherein said needle retaining means comprises a generally cylindrical interior cavity having rib means formed therein for positively retaining said handle means of said needle element in a pressure fit.

8. The needle assembly recited in claim 7, wherein said needle retaining means is formed with interior shoulder means for positive seating of the end of said mounting element of said needle assembly opposite the end from which said needle projects.

9. The needle assembly recited in claim 1, wherein said needle element comprises a threaded portion and a fairing to which said needle is removably secured.

10. The needle assembly recited in claim 2, wherein said rear end of said housing is formed as a raceway in which said nut is rotatably confined, said raceway having an open side to provide access to the outer surface of said nut to facilitate rotation thereof.

11. The needle assembly recited in claim 10, and further comprising a pair of tabs at the rear end of said raceway, the inner surfaces of said tabs being longitudinally spaced from and in alignment with said flat surface on the inside of said housing.

12. The needle assembly recited in claim 6, and further comprising elongated centering ribs located on the inside surface of said housing, spaced rearwardly from said needle end and extending along said inside surface parallel to said housing axis, said ribs providing a centering means for said mounting element and consequently for said needle as it extends outwardly from said housing.

* * * * *